United States Patent [19]

Hampshire et al.

[11] Patent Number: 4,637,322

[45] Date of Patent: Jan. 20, 1987

[54] ADJUSTABLE COMPUTER WORK TABLE

[75] Inventors: James F. Hampshire, Stephens City, Va.; Hugh F. Groth, Richfield; John M. Collins, Sagamore Hills, all of Ohio

[73] Assignee: Rubbermaid Commercial Products Inc., Winchester, Va.

[21] Appl. No.: 703,582

[22] Filed: Feb. 20, 1985

[51] Int. Cl.[4] ..... A47B 11/00

[52] U.S. Cl. ..... 108/102; 74/104; 108/7; 108/105; 108/147; 312/198

[58] Field of Search ..... 74/104, 422, 107; 108/1, 5, 6, 7, 8, 9, 102, 144, 145, 147, 105; 312/231, 198, 280

[56] References Cited

U.S. PATENT DOCUMENTS

| | | | |
|---|---|---|---|
| 667,350 | 2/1901 | Ulrich et al. | 74/104 X |
| 1,171,523 | 2/1916 | Kuhn . | |
| 1,691,634 | 11/1928 | Bienvenu . | |
| 2,187,312 | 1/1940 | Goodlake . | |
| 2,646,322 | 7/1953 | Laxo | 108/7 X |
| 3,049,390 | 8/1962 | Wolfe | 312/231 X |
| 3,052,057 | 9/1962 | May . | |
| 3,220,267 | 11/1965 | Smith | 74/107 X |
| 3,497,282 | 2/1970 | Backus | 312/231 |
| 3,603,545 | 9/1971 | Boniface . | |
| 3,611,453 | 12/1971 | Lokken . | |
| 3,690,608 | 9/1972 | Polzner . | |
| 4,154,173 | 5/1979 | Chesnut | 108/6 |
| 4,278,032 | 7/1981 | Kritske | 312/231 X |
| 4,365,561 | 12/1982 | Tellier et al. . | |
| 4,402,624 | 9/1983 | Stahl et al. | 108/7 |
| 4,428,631 | 1/1984 | Cope et al. . | |
| 4,440,096 | 4/1984 | Rice et al. . | |
| 4,515,086 | 5/1985 | Kwiecinski et al. . | |

*Primary Examiner*—James T. McCall

*Attorney, Agent, or Firm*—Richard B. O'Planick

[57] ABSTRACT

An adjustable work table is disclosed comprising a frame having spaced apart sides (6), a horizontal shaft (60) supported between the sides of the frame, and a table surface assembly (10) rotatively mounted to the shaft. Camming angular adjustment means (98, 110) is provided for rotating the table surface assembly into selective angular positions about the shaft. Vertically actuating scissor arms (44, 46) are further provided for moving the support shaft upward and downward whereby providing a vertical adjustment.

25 Claims, 6 Drawing Figures

ADJUSTABLE COMPUTER WORK TABLE

TECHNICAL FIELD

This invention relates to adjustable work tables in general, and specifically to computer work tables having a work surface which can be adjusted in one or more planes.

BACKGROUND OF THE INVENTION

Work tables having adjustable surfaces are well-known. Typically, such tables comprise a stand which has a work surface which can be vertically and angularly adjusted to align with an operator's line of vision. There is disclosed in U.S. Pat. No. 3,690,608 an adjustable stand comprising a telescopic vertical upright having a tilting mechanism at the top for supporting a table assembly in pedestal fashion. The tilting mechanism includes a worm gear which meshes with a gear wheel connected to the table assembly.

Several problems attend the operation of this type of stand. Because the worm gear supports the work table assembly and acts directly against the gear wheel carried thereby, the mechanical advantage gained from the mechanism is fixed at a one to one ratio. Further, the mechanism does not operate easily over the complete range of adjustment, varying in ease of operation with load distribution and the angular position of the table. Resultingly, the worm gear may prove difficult to turn at times.

Other shortcomings are inherent in this and other known work stands. The mechanical advantage attained by the tilt mechanism cannot be varied or tailored over the operating range of the mechanism. Further, the table axis of rotation and the rotary actuator crank axis are not coincident, making adjustment inconvenient. Finally, pedestal support of the table assembly does not provide a high level of torque restraint, resulting in a table assembly which is susceptible to undesirable movement from vibrations.

Surfaces are also known to be made vertically adjustable through operation of a scissor-type linkage. U.S. Pat. No. 3,611,453 discloses an adjustable bed having side mounted scissor-arms for elevating and tilting a bed surface forward and backward. Such known adjustment mechanisms, however, are cumbersome to operate and are ill-suited for work stands requiring leg room beneath the table surface. Moreover, such table assemblies do not provide for economic sharing of components between angular and vertical adjustment mechanisms, without sacrificing the operating independence of each mechanism.

SUMMARY OF THE INVENTION

According to the subject invention, therefore, an adjustable work table of the type generally defined above is provided. The work table comprises a frame having spaced-apart sides, a horizontal shaft supported between the sides of the frame, and a table surface assembly rotatively mounted to the shaft. Camming angular adjustment means is provided for rotating the table surface assembly into selective angular positions about the shaft. The camming adjustment means comprises a rack and pinion positioned to act upon a cam plate which rotatively connects the table assembly to the shaft. Movement of the pinion is controlled by a rotary control knob which has an axis of rotation coincident with the shaft axis. The rack is provided with inward directed pins, which reside within camming slots in the cam plate. Upon linear actuation of the rack, the pins ride against camming surfaces defining the cam plate slots and impart rotational torque to the cam plate. The mechanical advantage thus obtained can be readily varied by tailoring the pinion size, the rotary control knob diameter, or the camming slot shape. The pin-in-slot structure provides a high level of torque restraint for minimizing the effect of vibration. The camming mechanism further provides a self-actuating friction lock.

According to another aspect of the invention, the work table comprises scissor arms for moving the support shaft upward and downward. Pursuant to the subject invention, the horizontal shaft is utilized by both the angular adjustment and vertical adjustment mechanisms, yet both adjustments can be effected independently of the other. The scissor arms are compact in configuration, finely adjustable, and self-locking. Further, the scissor arms lift loads in a side to side balanced manner, which enhances structural stability.

Accordingly, it is an objective of the present invention to provide an adjustable work table assembly having readily modifiable angular adjustment means.

Still further, it is an objective of the present invention to provide an adjustable work table assembly having an angular adjustment means providing constant mechanical advantage over the operating range of the mechanism.

Yet a further objective of the present invention is to provide a conveniently adjustable work table assembly.

A further objective of the present invention is to provide an angularly adjustable work table assembly having a tilt mechanism which provides a high level of torque restraint, minimizing the effect of vibration.

Yet a further objective of the present invention is to provide an adjustable work table assembly having cooperative angular and vertical adjustment means.

A further objective is to provide an adjustable work table assembly having vertical adjustment means which is self-locking, finely adjustable, and which lifts loads in a balanced configuration.

Still a further objective is to provide an adjustable work table assembly which is economically and readily produced and readily assembled.

These and other objectives, which will become apparent to one skilled in the art, are achieved by a preferred embodiment which is described in detail below and which is illustrated in the accompanying drawings.

BRIEF DESCRIPTION OF THE ACCOMPANYING DRAWINGS

DETAILED DESCRIPTION OF THE PREFERRED EMBODIMENT

Figure 1:
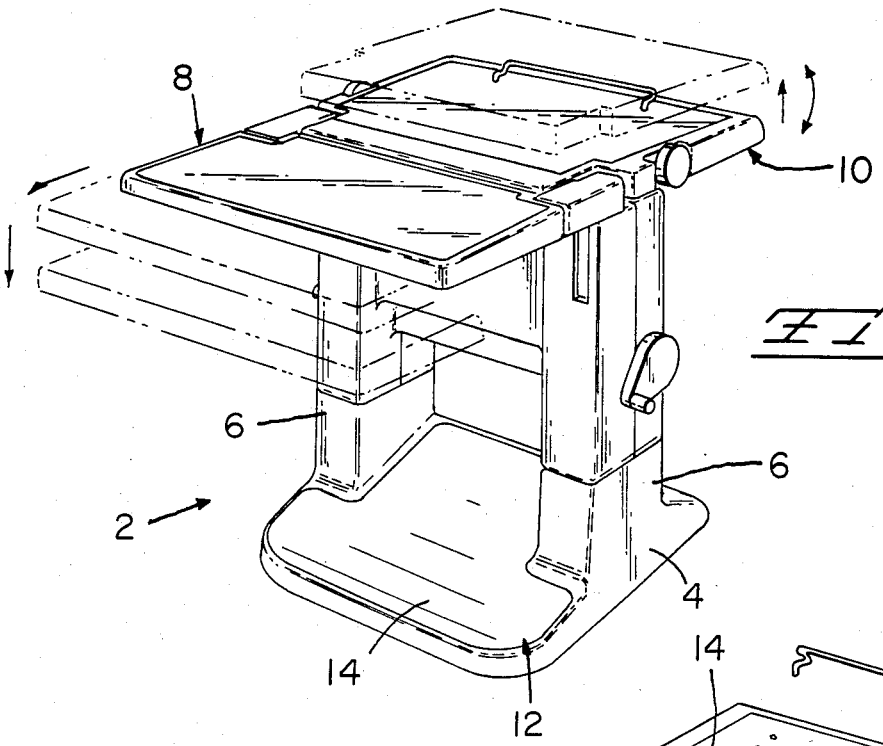
FIG. 1 is an assembled perspective view of the subject adjustable work stand.

Referring to FIG. 1, the computer work stand 2 is shown generally as comprising a rectangular pedestal base 4; two spaced-apart vertical support columns 6 extending upward from opposite sides of the base 4; a work surface assembly 8 positioned to the front of the work stand 2; a table surface assembly 10 positioned rearwardly of the stand; and a rearwardly inclined foot rest platform 12 spanning the base 4 between the columns 6. A rubber anti-skid matting 14 is affixed to the external surfaces of the work surface assembly 8, the table surface assembly 10, and the foot rest platform 12.

It will be appreciated that the work surface 8 is intended to receive the keyboard console of a computer or word processing system thereupon and is adjustable vertically to accommodate the operator. The table surface 10, which receives a monitor or cathode ray tube, can be adjusted both vertically and rotationally about a horizontal axis pursuant to the subject invention to thereby align with the operator's line of vision.

Figure 2:
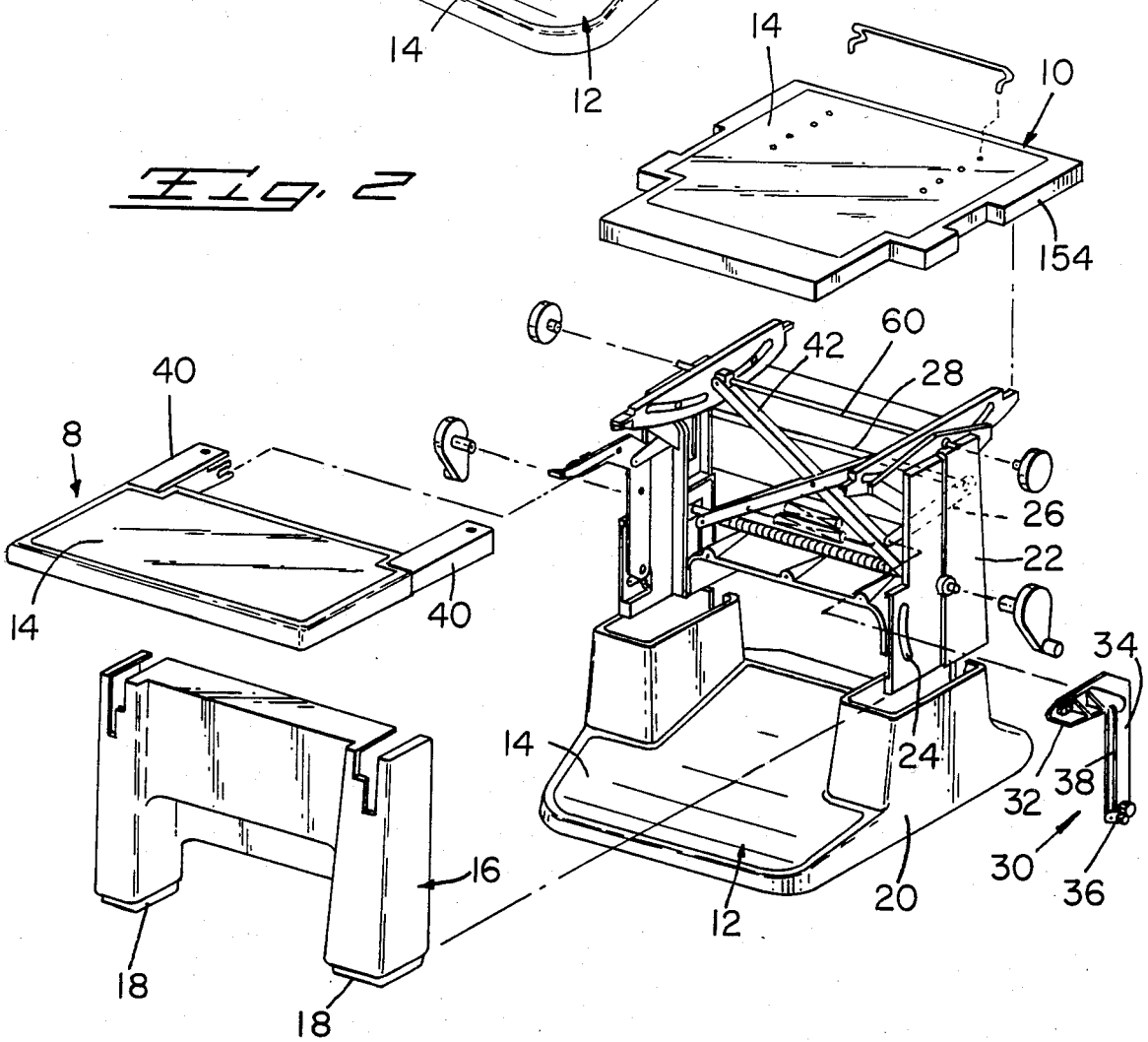
FIG. 2 is a partially exploded perspective view thereof.

As shown in FIG. 2, the work stand 2 is essentially symmetric about its vertical median axis. Accordingly, for the purpose of explanation, structural components comprising the left side of the stand shall be referred to by like numerals which correspond to mirror-image elements comprising the righthand portion of the stand.

A molded frontal cover 16, constructed of conventional plastic material, has incut bottom legs 18 of reduced sectional dimension which fit into the upper collar of a molded pedestal shell 20. Two spaced-apart plastic bearing plates 22 extend vertically upward from opposite sides of the pedestal 4, each of which being enclosed by a plastic shell (see FIG. 1). Each of the vertical bearing plates 22 has a vertical arcuate gear rack slot 24 therethrough positioned generally along the inward bottom side thereof.

Two horizontal metallic pivot arms 26 are provided having an inward end rigidly attached by means of welding, or the like, to opposite ends of a horizontal torsion shaft 28. The ends of the torsion shaft 28 are rotatively mounted to the vertical bearing plates 22, so that shaft 28 spans the width of the stand and is free to rotate about its horizontal longitudional axis. Rotation of shaft 28 causes horizontal pivot arms 26 to vertically rotate in unison therewith.

With continued reference to FIG. 2, a support arm assembly 30 is provided for attachment to each of the pivot arms 26 respectively. Each support assembly 30 includes a vertically rotatable lock release paddle 32 coupled to the horizontal segment of an L-shaped support plate 34. A pivoting gear cluster 36 is mounted to the lower distal end of the vertical segment of the L-shaped plate 34 and coupled to the paddle 32 by way of an elongate tie rod 38. The gear cluster 36 resides within the vertical arcuate slots 24 of the vertical bearing plates 22. Projecting forwardly from inward corners of the work assembly surface 8 are a pair of rectangular mounting brackets 40. The brackets 40 are mounted over the pivot arms 26 of the work stand and receive the actuator paddle 32 therein. Upon actuating paddles 32, the pivoting gear cluster 36 releases from the arcuate gear rack segment, and the work surface assembly is thereby freed for vertical repositionment.

Figure 3:
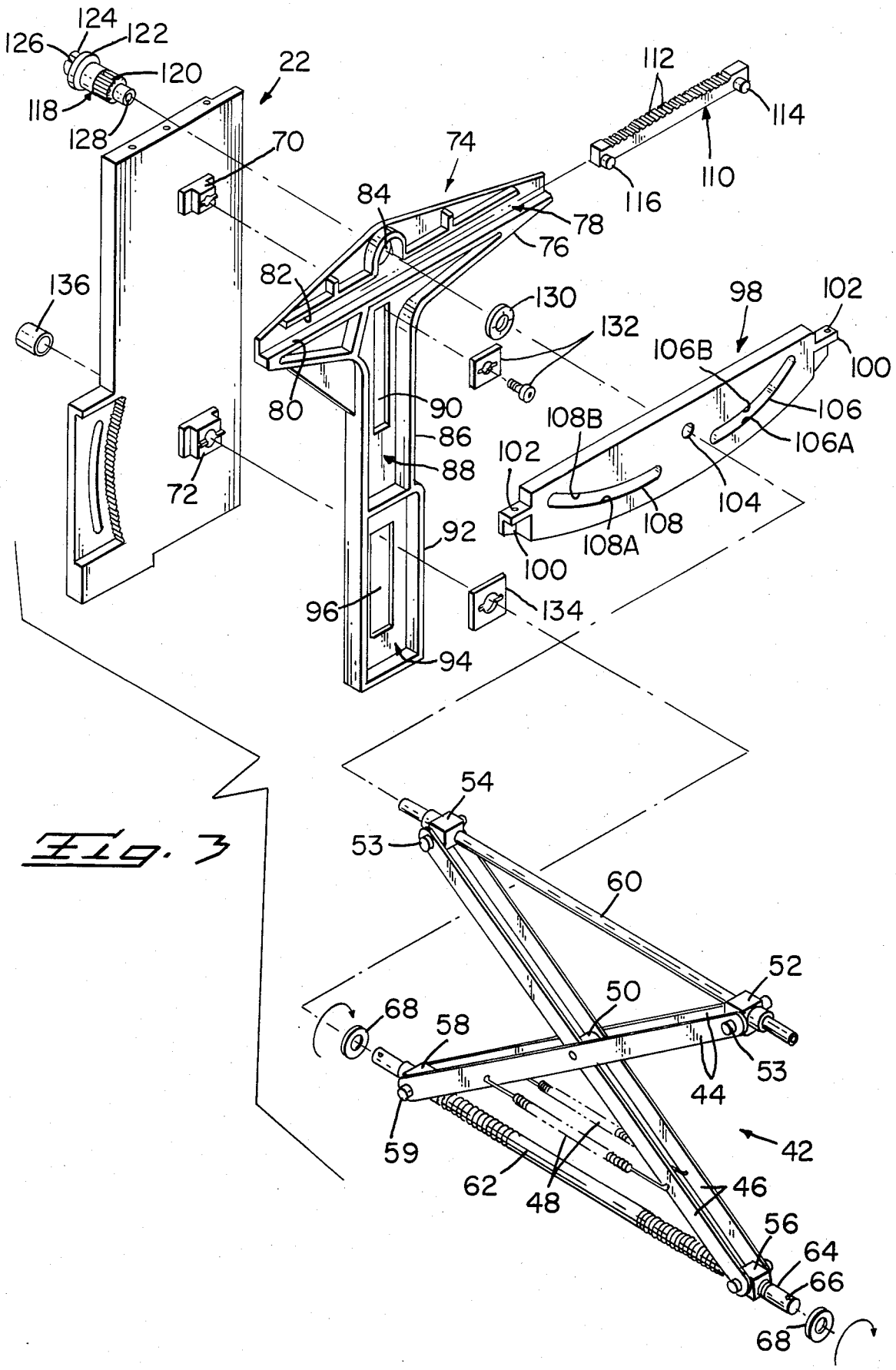
FIG. 3 is an exploded perspective view of the unique vertical and angular adjustment components comprising the subject invention.

With combined reference to FIGS. 2 and 3, the subject work stand further comprises a lift arm assembly 42, consisting of parallel and spaced-apart scissor arms 44 amd 46. The scissor arms 44, 46 intersect at their midsection and are separated at that point by a spacer block 50. Lower segments of scissor arms 44, 46 are coupled and placed in convergent tension by a pair of tension springs 48. Each of the scissor arms 44, 46 further are adapted having upper ends coupled to the opposite sides of a cubical block 52, 54, respectively. The upper ends of the scissor arms are fastened to the block by means of a retainer pin 53. Each of the cubical retainer blocks 52, 54 has a transverse axial bore for sliding receipt of a shaft therethrough.

The bottom ends of each of the pairs of scissor arms 44, 46 are further coupled to opposite sides of a second set of retaining blocks 56, 58 The lower arm ends are secured to the blocks by means of a second retaining pin 59, which fits through aligned apertures. Each of the lower retaining blocks 56, 58 is adapted having a threaded axial bore for receipt of a lead screw therethrough. The scissor arms, hinged about the spacer block 50, are thereby free to extend and retract in a vertical direction.

An elongate smooth surfaced through-shaft 60 is provided for extension through the upper retaining blocks 52, 54, between the sides of the work stand 2. The through shaft 60 is thus positioned in a horizontal orientation relative to the work stand and spans substantially the entire width of the stand between the sides thereof. It will be appreciated that the retaining blocks 52, 54 slidably converge and diverge along the axis of the through shaft 60.

A threaded lead screw 62 is positioned below and parallel to the through shaft 60 and likewise spans the width of the work stand between the sides thereof. The lead screw 62 projects through the lower threaded retaining blocks 56, 58 and has end portions 64 which are rotatably retained in the vertical bearing plates 22 of the work stand.

Each of the vertical bearing plates 22, as shown in FIG. 3, is of generally a rectangular shape having inwardly facing upper and lower boss projections 70, 72, which project therefrom for a purpose described below. Bearing plates 22 are rigidly affixed to the pedestal base of the work stand and provide general structural support along the sides of the stand. The ends 64 of the threaded lead screw 62 project through the bearing plates 22 and receive a washer 68 thereover. It will be appreciated that a rotation of the lead screw causes the lower retaining blocks 56, 58 to selectively travel inward or outwardly therealong, whereby extending and retracting the vertical reach of the scissor arms 44, 46. Because the upper ends of the scissor arms are journalled to bear against the through shaft 60, extension and retraction of the scissor arms causes the through shaft 60 to move upward and downward.

A pair of T-shaped support plates 74 are mounted to the bearing plates 22 of the work stand (the left one of which being depicted in FIG. 3), each of the support plates comprising an upper horizontal portion 76 having a horizontal inwardly open channel 78 extending there across. The channel 78 is defined by a bottom channel wall 80 and a top channel wall 82. The upper horizontal section 76 of the support plate is further adapted to provide a circular aperture 84 positioned generally above the horizontal channel 78.

A vertical mid-section 86 extends downwardly from the horizontal section 76 of the support plate 74 and is adapted having an inwardly open axial recess 88 therealong. A rectangular longitudional slot 10 is provided in the vertical mid-section 86 intended for receipt of the upper boss projection 70 of the bearing plate 22.

A lower vertical section 92 continues downwardly from the mid-section 86, and likewise provides an inwardly open axial recess 94. A lower rectangular longitudinal slot 96 extends through the lower vertical section 92 and is intended for receipt of the lower boss projection 72 therein. It will be appreciated that the support plate 74 can be unitarily molded of commercially available plastics material in a manner conventional to the industry.

A pair of horizontal, generally semi-elliptical, cam plates 98 are provided as integral components of the table surface assembly 10 (the left one of cam plates 98 being depicted in FIG. 3). Each cam plate 98 is formed having a generally flat top surface and an upwardly concave arcuate bottom surface which meet at opposite cam plate ends. Cam plate 98 is formed having incut end tabs 100, each having an assembly aperture 102 therethrough. It will be appreciated that the upper flat surfaces of the cam plates are intended to support a horizontal surface plate component 154 of the table surface assembly 10, and further that the incut tab apertures 102 receive mounting screws (not shown) which securely affix the surface plate 154 to the cam plates. Resultingly, the work table assembly 10 essentially comprises a horizontal top surface plate 154 having opposite sides to which dependent vertical cam plates 98 are attached.

With continued reference to FIGS. 2 and 3, each cam plate 98 further includes a central aperture 104 of a circular shape, dimensioned to receive the through shaft 60 of the work stand therethrough. Each cam plate 98 further provides a pair of upwardly concave arcuate camming slots 106, 108 therein, generally positioned below and to the opposite sides of the central aperture 104. The cam slot segments 106, 108 are defined by upper and lower camming surfaces 106A, 106B, and 108A, 108B. Cam slot segments 106, 108 each have a compound curvature explained further below. While segments 106, 108 are depicted as being separated in the preferred embodiment shown in FIG. 3, it will be appreciated to those skilled in the art that the cam segments can represent portions of a continuous compound cam slot which proceeds from one end of the cam plate 98 to the other, if so desired. Moreover, a single slot in one side of the plate 98 can be used if angular adjustment is to be limited to a 90° quadrant. The cam plates 98 can be integrally manufactured of commercially available, relatively hard, plastics material, molded in a manner conventional to the industry.

An elongate gear rack segment 110 is provided comprising a generally rectangular block, square in cross-section. The cam segment 110 is structurally configured to provide a linear segment of gear teeth 112 along an upward facing side thereof. The gear teeth 112 extend substantially the length of the gear rack segment 110. Inward facing cylindrical pins 114, 116 project from an inward facing side, from locations substantially proximate the ends of the gear rack segment 110. Each of the cylindrical pins 114, 116 are integrally formed to the body of the gear rack segment 110, and have a preferred diametric dimension of 1.27 cm. The spacing between pins 114, 116 is 16.19 cm.

With continued reference to FIG. 3, a complimentary cylindrical drive pinion 118 is provided having an annular series of meshing gear teeth 120 extending therearound generally intermediate the pinion member ends. An annular retention flange 122 is further provided around the pinion member 118 adjacent to an outward pinion end portion 124. A bore 126 extends transversely through the end portion 124. The drive pinion 118 is cylindrical and provides an axial bore 128 which extends the length of the pinion member.

Specifically referring to FIG. 3, assembly of the component angular adjustment and vertical adjustment mechanicms to the bearing plate 22 proceeds as follows. The support plate 74 is positioned against the bearing plate 22, with upper and lower boss projections 70, 72 protruding respectively through the vertical slots 90, 96. So situated, the support plate 74 is free to vertically move upward and downward relative to the bearing plate 22. Retention of the support plate 74 against the bearing plate 22 is achieved as upper and lower washer and nuts 132, 134 are assembled to the inward facing side of the support plate 74 and into threaded boss projections 70, 72.

The elongate gear rack segment 110 is inserted lengthwise into the horizontal channel 78 of the support plate 74 and is slidably retained therein by surfaces 80, 82 defining the channel. So positioned, the elongate rack segment can be axially moved along the linear path defined by the channel 78. The cylindrical pins 114, 116 face inwardly as depicted in FIG. 3. The complimentary pinion member 118 is inserted through the circular aperture 84 of the support plate 74, as flange 122 abuts against the outward face of the surface plate 74. Retention is secured by means of a tinnerman fastener 130 which is press fit over the inward end of the pinion member 118. The pinion member is rotatable about its longitudional axis transversely of the rack segment 110, and the annular pinion gear teeth 120 are held in meshing engagement with the rack gear teeth 112. It will be appreciated that directional rotation of the pinion member 118 causes the rack member 110 to move axially within the channel 78.

The cam plate 98 is thereafter positioned against the support plate 74, receiving cylindrical posts 114, 116 into the cam slot segments 106, 108, respectively. The central aperture 104 of the cam plate 98 coaligns with the aperture 84 of the support plate and the central axial bore 128 of the pinion member. An end of the through shaft 60 is inserted through the aperture 104 of the cam plate 98, aperture 84 of plate 74, and through the axial bore 128 of the pinion member 118. The ends of shaft 60 thereby support plates 74.

A cylindrical bearing bushing 136 is provided for residence within the lower boss projection 72. An end of the lead screw 62 projects through the bearing bushing 136 to emerge from the outside surface of the bearing plate 22.

Figure 4:
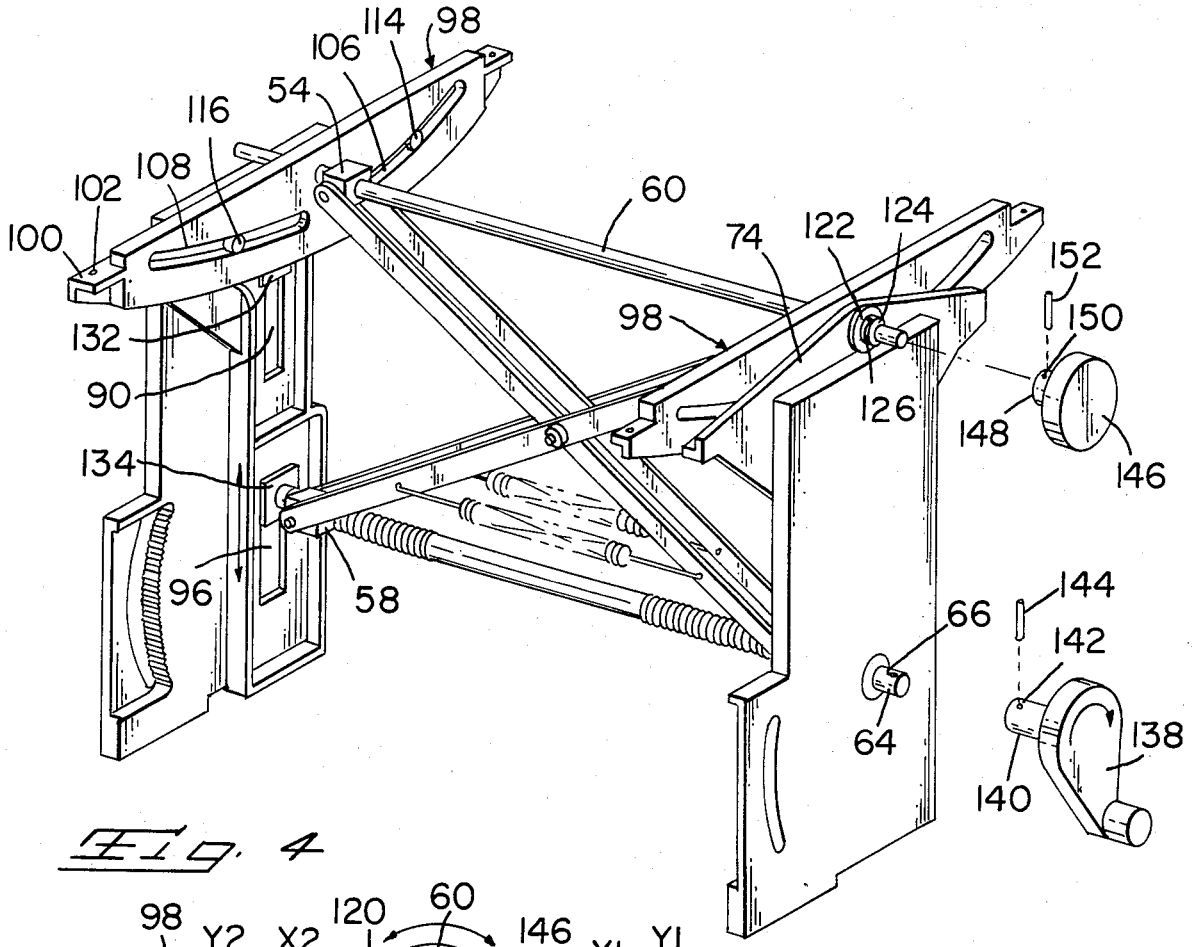
FIG. 4 is an assembled perspective view of the vertical and angular adjustment mechanisms comprising the subject invention.

FIG. 4 illustrates the vertical and angular adjustment sub-assembly. The end portion 64 of the lead screw 62 is received within an inward bored shank portion 140 of a rotary actuator crank 138. The shank portion 140 of actuator crank 138 has a cross bore 142 which receives an assembly pin 144 to thereby fixedly secure the actuator crank 138 to the lead screw 62. Consequently, directional rotation of the actuator crank 138 causes like-directional rotation of the lead screw 62.

An actuator knob 146 is provided which fits over the end portion of the through shaft and an end portion 124 of the drive pinion 118. An inward directed shank portion 148 is cross bored at 150 to receive an assembly pin 152. The pin 152 projects through the shaft end 124 and the pinion member 118. The actuator knob 146 is thereby fixedly connected to drive pinion 118.

With combined reference to FIGS. 2 and 4, it will be appreciated that the surface plate 154 of the table surface assembly 10 is affixed upon the flat upward surfaces of the cam plates 98. So located, an exposed mid-length of the through shaft 60 extends beneath the surface plate 154 between the cam plates 98. It is to this mid-section of the through shaft 60 that the scissor arms 44, 46 are slidably journalled. The upper ends of the scissor arms converge along the mid-portion of the through shaft 60 during upward extension of the scissor linkage independently of, and without interfering with, the rotational movement of the cam plates 98 about the through shaft 60. It will further be noted that the support plates 74 support the through shaft 60 proximate to the ends thereof in a balanced side-to-side manner. Structural stability is thereby maintained during vertical repositionment of the through shaft 60 and during angular adjustment of the surface assembly 10 coupled thereto.

Operation of the vertical adjustment and angular adjustment mechanisms described above will now be explained in further detail. Rotary actuation of the crank 138 causes like directional rotation of the lead screw 62, causing extension and retraction of the scissor arm linkages. The fineness of adjustment is directly related to the thread density along the lead screw and can thereby be varied, if desired. Also, the thread density directly relates to the mechanical advantage provided by the mechanism. Further, it will be recognized that the scissor linkages are compact in design and fit conveniently between the sides of the work stand so as not to detract from the aesthetic external appearance of the stand. Threaded coupling of the lower ends of the scissor arms to the lead screw further results in the vertical adjustment mechanism being self-locking, which insures that the mechanism will hold its vertical position. Finally, the scissor linkage bears directly against the through shaft 60 below sides of the load bearing support plate 154. Efficient balanced application of vertically directed forces against support plate 154 is thereby achieved.

Operation of the angular adjustment mechanism is as follows, with reference to FIGS. 4, 5, and 6. It will be appreciated that the dimension of the cylindrical pins 114, 116 is such that they are closely received into the cam segment slots 106, 108 of the cam plate 98. There located, the pins 116 bear against the upper and lower surfaces defining the cam slot segments. As the actuator knob 146 is turned, correspondent rotation of the drive pinion 118 results. The gear rack segment 110 is directionally moved along a linear path transverse of the longitudional axis of shaft 60. As gear rack segment 110 so moves, cylindrical pins 114, 116 travel along the camming surfaces 106A, 106B, and 108A, 108B, thereby imparting rotational torque to the cam plates 98. Rotational motion is, accordingly, transposed into linear motion via the rack and pinion and then back into rotary motion by way of the pin and cam slots. An angular displacement reduction ratio between the knob 146 and the cam plates 98 can resultingly be obtained, preferably to the order of 30 to 1, representing the mechanical advantage of the mechanism.

The above referred to mechanical advantage, it will be noted, is constant over the range of operation of the mechanism. That is, the mechanical advantage does not vary with the angular location of the surface assembly 10 about the shaft 60. Moreover, the mechanical advantage can be easily varied without departing from the basic design of the mechanism. This can be achieved by modifications to the shape of the slot (the cam follower). For example, a more acute slot arc would lower the angular displacement reduction ratio, and vice versa. This method of varying the mechanical advantage can be done progressively over the length of the pin travel in the slot so as to render the mechanical advantage nonconstant if desired. For example, the mechanical advantage could be tailored in a specific adjustment range to improve adjustment sensitivity or reduce forces. Another way of modifying mechanical advantage would be to vary the size of the pinion member. This method retains the original mechanical advantage pattern of the slots, but varies the portion of the mechanical advantage contributed by the rack and pinion in a constant manner. A third way to vary the mechanical advantage, also in a constant ratio, is to change the size of the actuator knob. All of the above modifications can be done with a minimal part substitution.

Figure 5:
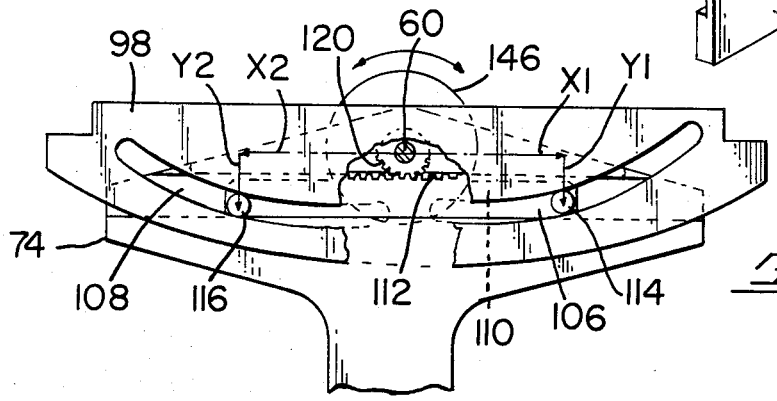
FIG. 5 is a schematic side elevation representation of the angular adjustment mechanism shown in the balanced or level configuration.

FIG. 5 illustrates the cam plates 98 in a horizontal orientation, with the gear rack segment 110 symmetrically positioned relative to the drive pinion. FIG. 6, in sequence to FIG. 5, shows progression of the gear rack segment 110 to the right, responsive to counterclockwise (referenced to the drawing plane) rotation of the actuator knob 146. Resultingly, the cam plates 98 rotate in a clockwise direction, contrary to the direction of the actuator knob 146. Because the actuator knob axis and the through shaft axis are coincident, the operator can conveniently coordinate rotation of the actuator knob with the desired angular position change of the surface assembly.

Figure 6:
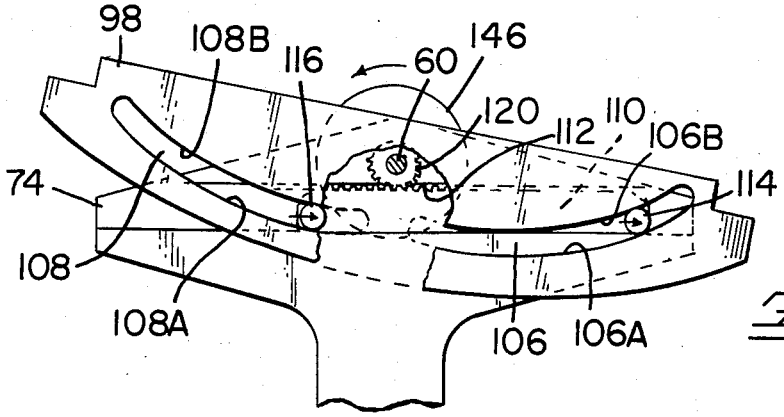
FIG. 6 is a side elevation view of the angular adjustment mechanism shown in sub-sequence to FIG. 5 illustrating the work table in an acutely tilted condition.

It will further be readily apparent from FIG. 6 that friction in the system can make the tilting system self-locking at any position.

Frictional forces acting upon the camming pins 114, 116, as well as between the rack 110 and slot 78 lock the inclined table assembly 10 in a stationary position. The pressure angle between pins 116, 114 and the slot upper and lower camming surfaces 106A, 106B, 108A, 108B must be kept below the arctan of the coefficient of friction between the rack 110 and the support arm surfaces 80, 82 (as shown in FIG. 3) to maintain the self-locking function.

As mentioned above, each of the slots 106, 108 has a unique, compound curvature, defined by the following table which indicates the positionment of pins 114, 116 in slots 106, 108 at given angular table positions. FIG. 5 illustrates coordinates X-1, Y-1 for pin 114 and coordinates X-2, Y-2 for pin 116, as measured from the center of shaft 60 to define the constant mechanical advantage as described above.

The table below correlates the coordinates (in centimeters), with the tilt angle (in degrees).

| TILT | SLOT 106 | | SLOT 108 | |
|---|---|---|---|---|
| ANGLE | X1 | Y1 | X2 | Y2 |
| 15 | 1.60 | 3.06 | 14.34 | −1.21 |
| 14 | 2.12 | 3.14 | 13.89 | −.84 |
| 13 | 2.64 | 3.21 | 13.44 | −.49 |
| 12 | 3.16 | 3.27 | 12.97 | −.16 |
| 11 | 3.69 | 3.30 | 12.51 | .15 |
| 10 | 4.22 | 3.32 | 12.03 | .45 |
| 9 | 4.75 | 3.32 | 11.55 | .74 |

-continued

| TILT ANGLE | SLOT 106 X1 | SLOT 106 Y1 | SLOT 108 X2 | SLOT 108 Y2 |
|---|---|---|---|---|
| 8 | 5.28 | 3.30 | 11.06 | 1.01 |
| 7 | 5.81 | 3.27 | 10.56 | 1.26 |
| 6 | 6.35 | 3.22 | 10.06 | 1.49 |
| 5 | 6.88 | 3.15 | 9.56 | 1.71 |
| 4 | 7.41 | 3.06 | 9.05 | 1.91 |
| 3 | 7.94 | 2.95 | 8.54 | 2.09 |
| 2 | 8.47 | 2.83 | 8.02 | 2.26 |
| 1 | 9.00 | 2.69 | 7.50 | 2.41 |
| 0 | 9.52 | 2.54 | 6.98 | 2.54 |
| −1 | 10.04 | 2.36 | 6.46 | 2.65 |
| −2 | 10.56 | 2.17 | 5.93 | 2.74 |
| −3 | 11.07 | 1.96 | 5.40 | 2.82 |
| −4 | 11.59 | 1.73 | 4.87 | 2.88 |
| −5 | 12.09 | 1.49 | 4.35 | 2.93 |
| −6 | 12.59 | 1.22 | 3.82 | 2.95 |
| −7 | 13.09 | .95 | 3.29 | 2.96 |
| −8 | 13.57 | .65 | 2.77 | 2.95 |
| −9 | 14.06 | .34 | 2.24 | 2.92 |
| −10 | 14.53 | .01 | 1.72 | 2.88 |

With reference to FIGS. 5 and 6, each slot 106, 108 comprises an upwardly concave arcuate curve having relatively large, non-constant radii of curvature. Each slot accordingly presents a generally flat portion toward its inward end and a more acutely arcing portion at its outward end. Each slot is dimension to closely receive the 1.27 centimeter in diameter pins 114, 116 therein, such that as the pins move along each slot, frictional engagement between the pins 114, 116 and slot surfaces 106A, 106B, and 108A, 108B, respectively, is maintained.

The pin-slot pressure angles established by the shape of slots 106, 108 makes the mechanism self-locking. The mass supported by each cam plate can be resolved into a force vector acting upon pins 114, 116. Because the curvature radii of each slot is large, the normal component of this force vector as applied through surfaces 106A, 106B, 108A, and 108B, to pins 114, 116 has a relatively large magnitude. The frictional forces resistive to pin movement in slots 106, 108, which are directly proportionate to the normal force component, and are accordingly of a large magnitude. Thus, a positive frictional lock is achieved which activates automatically in response to the mass of the table assembly. The greater the weight carried by the table, the greater the normal forces acting upon the pins, and the tighter the resultant lock.

While the preferred embodiment of the subject invention envisions the use of dual camming pins 114, 116, it will be readily appreciated that one camming pin could suffice if desired. It should be apparent from FIG. 6 that the pin and slot tilt mechanism provided by the subject invention further provides a high level of torque restraint because of the balanced manner in which the pins support the weight of the surface assembly and because of the residual friction between the pins and the cam plates 98. This eliminates the effect of vibration upon the surface assembly, and results in a more stable work surface structure.

While the above describes the preferred embodiment of the present invention, the teachings herein disclosed are not intended to be so restricted. Other embodiments which would utilize the teachings herein set forth are intended to be within the scope and intention of the subject invention.

We claim:

1. An adjustable work table comprising: a frame having spaced-apart vertical sides; a horizontal through-shaft having a longitudinal axis extending between said frame sides; each said frame side including support means for supporting opposite ends of said shaft; a table surface assembly rotatively mounted to said shaft between said frame sides; camming angular adjustment means for rotating said table surface assembly into selective angular positions about said shaft; said angular adjustment means comprising rotary control means having an axis of rotation coincident with said shaft axis.

2. An adjustable work table comprising: a frame having spaced-apart vertical sides; a horizontal through-shaft having a longitudinal axis extending between said frame sides; each said frame side including support means for supporting opposite ends of said shaft; a table surface assembly rotatively mounted to said shaft between said frame sides; camming angular adjustment means for rotating said table surface assembly into selective angular positions about said shaft; said angular adjustment means comprising actuator means mounted to at least one said frame side movable along a linear path transverse to said shaft axis, and said work table assembly comprising means responsive to said linear actuator means movement for rotating said table assembly.

3. An adjustable work table as set forth in claim 2, wherein said work table assembly means responsive to said actuator means comprising at least one depending cam plate.

4. An adjustable work table as set forth in claim 3, said cam plate being located adjacent to said actuator means and having a central aperture for receiving an end of said shaft therethrough, whereby said cam plate being rotatable about said shaft.

5. An adjustable work table as set forth in claim 4, said cam plate further having at least one camming slot therein, comprising at least one upwardly concave arcuate slot segment located below said central aperture, and said camming slot being defined by top and bottom camming surfaces.

6. An adjustable work table according to claim 5, wherein said actuator means having at least one pin projecting inwardly for close receipt into said camming slot, whereby concurrently with said linear actuator means movement, said pin travels along said camming slot engaging said arcuate camming surfaces.

7. An adjustable work table according to claim 6, said cam plate supporting said work table assembly means such that the weight of said work table assembly means is transmitted through said cam plate and brought to bear upon said actuator means pin.

8. An adjustable work table according to claim 7, or claim 2, said actuator means comprising:

an elongate rack segment having gear teeth along one side, and mounted to move axially along said linear path; and a rotary pinion member mounted transversely of said rack segment and having annular teeth for meshing engagement with said gear rack teeth.

9. An adjustable work table according to claim 8, wherein said pinion member being rotatively mounted to said frame side support means and having a central axial bore for coaxial receipt of an end of said shaft therein.

10. An adjustable work table according to claim 9, wherein said support means comprising an inward facing vertical support plate having an upper transverse channel portion for receiving said gear rack segment, and a through-aperture above said channel portion for retaining said pinion member therein.

11. An adjustable work table according to claim 10, wherein said support means further comprising a stationary bearing plate, said support plate further having a lower portion slideably mounted to said bearing plate such that said support plate is free to reciprocally move in a vertical direction.

12. An adjustable work table according to claim 11, wherein said work table further comprising vertical adjustment means for integrally moving said shaft and said vertical support plate upward and downward.

13. An adjustable work table comprising:

a frame having spaced apart vertical sides;

a horizontal through-shaft having a longitudinal axis extending between said frame sides;

vertically positionable support means mounted to each said frame side for supporting opposite ends of said shaft;

a table surface assembly rotatively mounted to said shaft between said frame sides;

angular adjustment means mounted to said support means for rotating said table surface assembly into selective angular positions about said shaft;

vertical adjustment means for moving said support means and said shaft upward and downward.

14. An adjustable work table according to claim 13, said vertical adjustment means acting upon said through-shaft.

15. An adjustable work table according to claim 14, said table surface assembly having a generally horizontal surface plate and dependent end portions rotatively affixed to said through-shaft, whereby an exposed mid-length of said shaft proceeds between said dependent portions and beneath said surface plate.

16. An adjustable work table according to claim 15, said vertical adjustment means comprising:

a horizontal threaded lead screw situated below and parallel to said shaft, and having opposite ends rotatively supported by said frame sides;

first and second crossing jack linkages, each comprising two parallel and spaced apart scissor arms having bottom arm ends threadedly journalled to said lead screw, and upper arm ends slideably coupled to said shaft mid-length portion, whereby directional rotation of said lead screw causing selective extension and retraction of said jack linkages and correspondent ascent and descent of said shaft.

17. An adjustable work table according to claim 16, further comprising tension spring means connecting lower portions of said first and second scissor arms whereby spring assisting extension of said jack linkages.

18. An adjustable work table having integral locking means comprising:

a. an elongate through shaft having a longitudional major axis;

b. means for supporting opposite ends of said through shaft;

c. table surface means comprising at least one dependent cam plate for supporting said surface means; said cam plate having a central aperture receiving said shaft therethrough whereby said cam plate rotating about said shaft, and said cam plate further having at least one cam slot therethrough defined by top and bottom camming surfaces; and d. pin projection means closely residing within said slot and frictionally engaging said arcuate camming surfaces.

19. An adjustable work table according to claim 18, said cam slot comprising at least one upwardly concave slot segment located below said central aperture.

20. An adjustable work table according to claim 19, further comprising actuator means for moving said pin projection means along said slot segment, whereby imparting rotational torque to said cam plate.

21. An adjustable work table according to claim 20, further comprising adjustment means for selectively moving said shaft and said means supporting said shaft laterally of said shaft axis.

22. An adjustable work table according to claim 21, wherein said adjustment means acting upon said shaft.

23. An adjustable work table according to claim 19, said actuator means being movable along a linear path transverse to said shaft axis.

24. An adjustable work table according to claim 23, said actuator means comprising:

a gear rack segment axially movable along said linear path, and having gear teeth along one side, and said pin projection means extending from an inward facing second side of said gear rack segment;

a rotary pinion member situated transverse to said gear rack segment said and having annular gear teeth for meshing engagement with said rack segment.

25. An adjustable work table according to claim 24, said pinion member having a central axial bore for coaxial receipt of an end of said shaft therein.

* * * * *